United States Patent [19]

Harris

[11] 4,185,689

[45] Jan. 29, 1980

[54] CASING BRIDGE PLUG WITH PUSH-OUT PRESSURE EQUALIZER VALVE

[75] Inventor: Allen E. Harris, Duncan, Okla.

[73] Assignee: Halliburton Company, Duncan, Okla.

[21] Appl. No.: 939,532

[22] Filed: Sep. 5, 1978

[51] Int. Cl.[2] ..... E21B 23/00

[52] U.S. Cl. ..... 166/133; 166/188

[58] Field of Search ..... 166/133, 188

[56] References Cited

U.S. PATENT DOCUMENTS

| | | | |
|---|---|---|---|
| 2,300,854 | 11/1942 | Allen et al. | 166/193 |
| 3,002,563 | 10/1961 | Crowe | 166/133 |
| 3,042,116 | 7/1962 | Sharp et al. | 166/133 |
| 3,420,304 | 1/1969 | Kilgore | 166/133 |

*Primary Examiner*—James A. Leppink
*Assistant Examiner*—Richard E. Favreau
*Attorney, Agent, or Firm*—James R. Duzan; John H. Tregoning

[57] ABSTRACT

A bridge plug having an ejectable plug assembly means in the bore thereof and means for catching the ejectable plug assembly means.

2 Claims, 3 Drawing Figures

CASING BRIDGE PLUG WITH PUSH-OUT PRESSURE EQUALIZER VALVE

This invention relates to an improved bridge plug for wells and, more particularly, to an improved bridge plug in which the pressure differential acting across the bridge plug can be equalized prior to the removal of the bridge plug from the well.

When a bridge plug is to be removed from the bore of a steam or gas well where the formation pressure has been allowed to build up below the bridge plug thereby causing a high differential pressure thereacross, it is desirable to allow the pressure differential acting across the bridge plug to be equalized to allow the safe removal of the bridge plug from the wellbore. Typically, bridge plugs are removed from wellbores by either a conventional drill bit or by a special type milling tool which has a portion inserted in the bridge plug bore to act as a guide member while a cylindrical portion of the tool mills away the bridge plug slips and packer element which engage the wellbore. If the pressure differential acting across the bridge plug is not equalized before either the bridge plug milling tool or the drill bit destroys the top set of bridge plug slips engaging the wellbore, when the top set of bridge plug slips are destroyed, the pressure differential acting across the total area of the bridge plug can provide a lifting force of sufficient magnitude to lift the drill string and attached milling tool or drill bit from the wellbore.

It should also be recognized that during bridge plug removal operations utilizing either milling tools or conventional drill bits it is desirable to remove as much of the debris from the bridge plug as possible to prevent the debris from fouling the well and surface equipment during subsequent well production operations.

Typical prior art packers and bridge plug which contain an ejectable plug assembly in the bridge plug bore to allow the pressure differential across the bridge plug to be equalized before the removal of the bridge plug from the wellbore are illustrated in U.S. Pat. Nos. 2,928,469; 3,002,563; and 3,042,116. However, while these packers and bridge plug have an ejectable plug, to remove the ejectable plug from the packers or bridge plug it is necessary to supply a force to the ejectable plug sufficient to overcome the pressure below the packer or bridge plug acting on the bottom of the ejectable plug in addition to the required force to cause the ejectable plug to be expelled from its mechanical engagement with the packer or bridge plug bore. In certain instances where high formation pressures exist below the packer or bridge plug, it may be difficult or impossible to apply a sufficient force to overcome the formation pressures acting on the bottom of the ejectable plug and the force required to cause the ejectable plug to be expelled from mechanical engagement with the packer or bridge plug bore. Also, when the packer or bridge plug is retrieved from the wellbore, the ejectable plug remains in the wellbore having fallen to the bottom thereof since it was ejected from the packer or bridge plug without any provision for the retention thereof.

Other types of prior art packers and bridge plugs use sliding relief valves in the bore thereof or in combination therewith to allow the equalization of the differential pressures thereacross. Such prior art packers and bridge plugs are exemplified by U.S. Pat. Nos. 3,141,506; 3,454,089; 3,871,448; 3,931,855 and 3,970,145.

However, such prior art packers and bridge plugs are unusually complex to manufacture and operate in service as well as being costly to use in applications where the packer or bridge plug is expended.

In contrast to the prior art devices, the present invention comprises a bridge plug having an ejectable plug in the bridge plug bore which allows the differential pressure acting across the bridge plug to be equalized before the removal of the bridge plug from the wellbore, which only requires sufficient force to be applied thereto to overcome the mechanical engagement with the bridge plug bore and which is retained by the bridge plug after the ejection from the bridge plug bore.

The foregoing advantages and the preferred embodiment of the present invention will be better understood from the following specification taken in conjunction with the accompanying drawings wherein.

Figure 1:
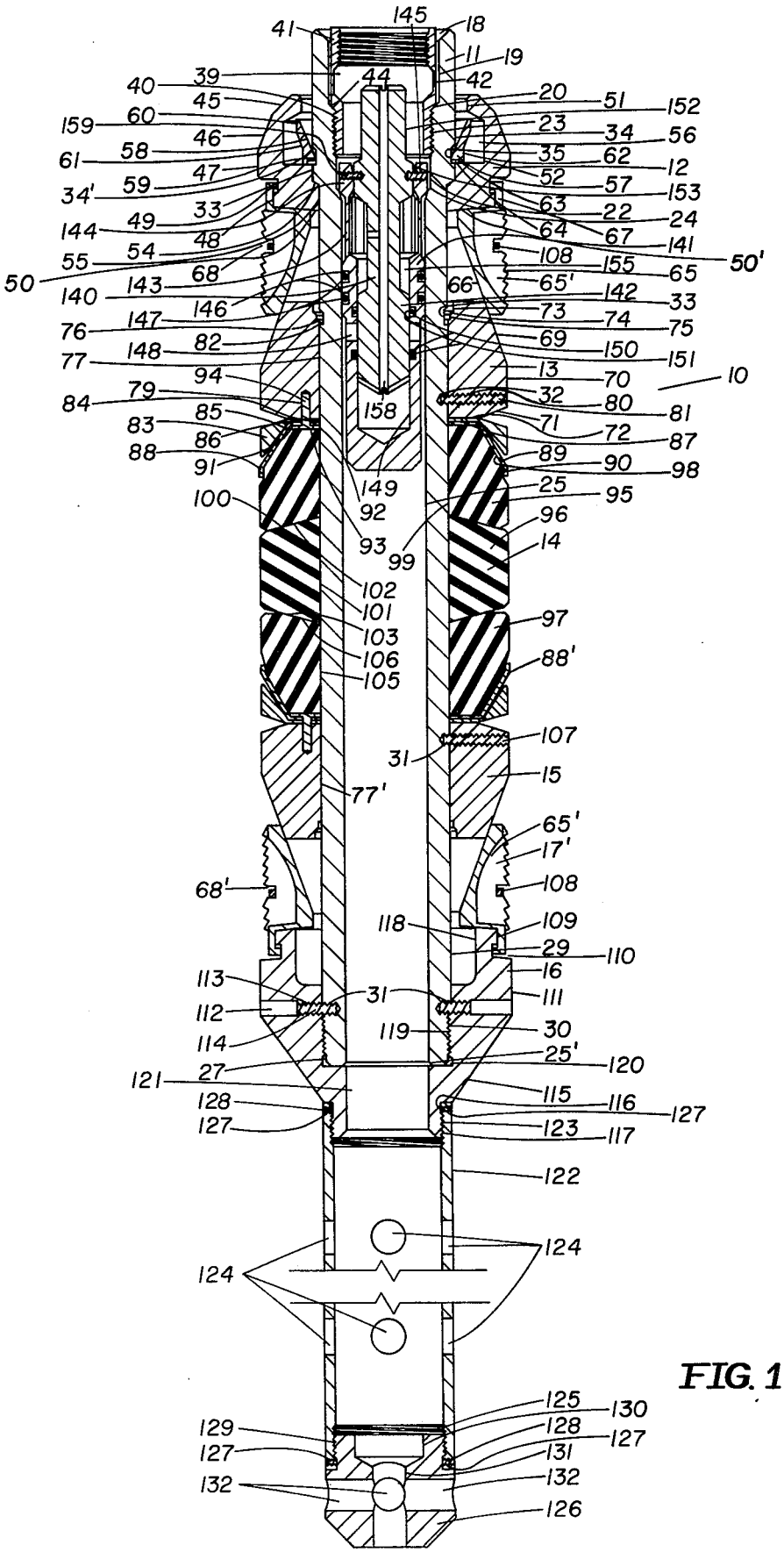
FIG. 1 is a cross-sectional view of the preferred embodiment of the present invention.

Referring to FIG. 1, the invention is shown in its preferred embodiment.

The bridge plug 10 comprises a bridge plug mandrel 11, upper slip support 12, upper slip wedge 13, packer assembly 14, lower slip wedge 15, lower slip support 16 and slips 17 and 17'.

The bridge plug mandrel 11 comprises an elongate unitary member. The interior surface of the bridge plug mandrell 11 comprises a chamfered inlet 18, a first bore 19 terminating in an annular seat 21, a second bore 22 having a threaded upper end 23 and terminating at its lower end at chamfered annular seat 24, and a central bore 25 terminating in a chamfered annular surface 25' on the lower end thereof. The exterior surface of the bridge plug mandrel 11 comprises a lower annular face 26, a first cylindrical portion 27, a second cylindrical portion 29 having a threaded section 30, having a plurality of circumferentially threaded holes 31 in the lower portion thereof, having a plurality of circumferentially spaced threaded holes 32 and having annular channel 33 in the upper portion thereof, and a third cylindrical portion 34 having an annular channel 35 formed therein and having annular chamfered shoulder 34' thereon. The packer mandrel may be formed of any suitable material.

The upper slip support 12 comprises an annular collar. The exterior of the slip support 12 comprises a first annular chamfered surface 45, second annular chamfered surface 46, first cylindrical surface 47, second cylindrical surface 48 having an annular channel 49 therein, and lower surface 50. The interior of the slip support 12 comprises a first bore 51, a second bore 52, a third bore 53, annular chamfered seat 54 and a fourth bore 55. The second bore 52 is of greater diameter than first bore 51 and third bore 53 thereby forming a cavity 56 in which lock ring 57 is carried. Alternately, the exterior of the slip support 12 may comprise a first annular chamfered surface 45, a first cylindrical surface 47 which mates with surface 45, a second cylindrical surface 48 having annular channel 49 therein, and lower surface 50. The upper slip support 12 may be formed of any suitable material, although soft cast iron is preferred.

Lock ring 57 comprises a split annular ring having a conically shaped interior surface 58 terminating in a cylindrical portion 59 at the lower end thereof while the exterior surface is formed of a first cylindrical portion 60, a conically shaped portion 61 and a second cylindrical portion 62. The lower end face 63 of the lock ring 57 has a recess 64 formed therein so that only a portion of the lower end face 63 abuts upper slip support 12 when the lock ring 57 is installed in recess 56 of the upper slip support 12. The lock ring 57 can be formed of any suitable metal, although aluminum is preferred.

When installed on the packer mandrel 11, the upper slip support 12 is installed with annular chamfered seat 54 abutting annular chamfered shoulder 34' on the packer mandrel 11 and with lock ring 57 installed in annular channel 35 of the packer mandrel 11 with end face 63 of the lock ring 57 abutting the wall of recess 56 in the upper slip support 12. As installed, the upper slip support 12 is prevented from upward movement on the packer mandrel 11 since annular chamfered seat 54 abuts annular chamfered shoulder 34' on packer mandrel 11 while only limited downward movement of the upper slip support is permitted since lock ring 57 will abut a wall of recess 56 and recess 64 of the end face 63 will abut wall 35' of annular channel 35 in packer mandrel 11.

The slips 17 comprise arcuate shaped members having a serrated cylindrical exterior surface 65 interrupted by one or more arcuate shaped longitudinal slots 65', a generally conically shaped interior surface 66, and an attachment lip 67. The serrated cylindrical exterior surface 65 of each slip 17 contains a circumferential channel 68. Each slip 17 is supported at one end by the upper slip support 12 by means of the attachment lip 67 of the slip 17 mating with annular channel 49 of the upper slip support 12 with surface 50' of the slip engaging surface 50 of the slip support 12. The other end of the slip 17 is supported by the upper slip wedge 13. Although the slips 17 may be made of any suitable material, hard cast iron is preferred.

The upper slip wedge 13 comprises an annular collar having an exterior surface comprising a first conically shaped portion 69 terminating in a cylindrical portion 70 which, in turn, terminates in a second conically shaped portion 71 having an end face 72, and an interior surface comprising a first bore 73 terminating in an annular chamfered seat 74, a second bore 75 terminating in a shoulder 76 and a third bore 77. The first conically shaped portion 69 of the exterior surface of the upper slip wedge 13 is formed at a conical angle substantially the same as the conical angle of the conically shaped interior surface 66 of the slip 17 to allow the slip 17 to be cammed outwardly upon relative movement between the slip 17 and the upper slip wedge 13. The upper slip wedge 13 is formed with a plurality of axial holes 79 in the end face 72 and a plurality of threaded circumferentially spaced holes 80 which extend from the cylindrical portion 70 of the exterior surface to bore 77 of the interior surface. The upper slip wedge 13 may be formed of any suitable material, but soft cast iron is preferred.

The upper slip wedge 13 is retained on the packer mandrel 11 by a plurality of machine screws 81 which engage threaded holes 80 in the upper slip wedge 13 and threaded holes 32 in the packer mandrel 11. The upper end of the upper slip wedge 13 is centered about packer mandrel 11 by means of resilient ring 82 installed in abutting engagement with shoulder 76 at the termination of bore 75 of the slip wedge 13. The resilient ring 82 is preferably installed with an edge abutting a chamfered annular side wall 33' of annular channel 33 in the bridge plug mandrel 11 to facilitate the centering of the slip wedge 13 about the bridge plug mandrel 11 and to prevent premature setting of the slips 17 when inserting the bridge plug 10 in a wellbore. The resilient ring 82 may be formed of any suitable resilient material.

Abutting end face 72 of upper slip wedge 13 is a back-up ring 83 which serves as a back-up for the packer assembly 14 during the compression thereof. The back-up ring 83 comprises an annular collar having a central bore 84, conically shaped interior surface 85 and a plurality of holes 86 spaced about a reduced thickness portion 87. The back-up ring 83 is formed from brass, although any suitable material may be used.

Abutting the reduced thickness portion 87 of the back-up ring 83 is a packer shoe 88. The packer shoe 88 comprises a generally conically shaped member having a conically shaped portion 89, cylindrical end portion 90 and central portion 91 having a bore 92 and a plurality of holes 93 therethrough. The packer shoe 88 serves as a bearing surface during the compression of the packer assembly 14. Similar to the back-up ring 83, the packer shoe 88 is formed of brass material, although any suitable material may be used.

To prevent rotation of the back-up ring 83 and packer shoe 88, a plurality of pins 94 are inserted into holes 79 of the upper slip wedge 13 via holes 86 in back-up ring 83 and holes 93 in packer shoe 88.

The packer assembly 14 comprises an upper packer element 95, a center packer element 96 and a lower packer element 97. The upper packer element 95 is formed with a conically shaped exterior surface portion 98 which mates with packer shoe 88, with a bore 99 through which bridge plug mandrel 11 extends and with an angularly shaped, with respect to the horizontal axis of the packer element, lower end face 100 which abuts packer element 96. The center packer element 96 is formed with a bore 101 through which bridge plug mandrel 11 extends and with angularly shaped, with respect to the horizontal axis of the packer element, end faces 102 and 103 which abut upper packer element 95 and lower packer element 97 respectively. The lower packer element 97 is formed with a conically shaped exterior surface portion which mates with packer shoe 88', with a bore 105 through which bridge plug mandrel 11 extends and with an angularly shaped, with respect to the horizontal axis of the packer element, upper face 106 which abuts face 103 of center packer element 96.

The angles at which the abutting end faces 100, 102 and 103, 106 of the packer elements 95, 96 and 97 respectively are constructed with respect to the horizontal axes of the elements vary depending upon the type of elastomeric material from which the packer elements are formed. For example, if the packer elements 95, 96 and 97 are formed of BUNA-N type rubber, the angular end faces 100, 102 and 103 of the packer elements 95 and 96 respectively are formed at a 15 degree angle while end face 106 of the packer element 97 is formed at a 20 degree angle. Although the packer elements 95, 96 and 97 may be formed of any suitable elastomeric material, BUNA-N type rubber is preferred. It should be noted that unless the packer elements are formed with the proper angular relationship, the packer assembly will not eventually expand upon compressional loading.

The packer shoe 88' and the back-up ring 83' are identical in construction to the packer shoe 88 and back-up ring 83 described hereinbefore and, therefore, will not be described in detail.

It should be noted that the back-up rings 83, 83' and packer shoes 88, 88' are installed on either side of the packer assembly 14 to prevent the extrusion of the packer assembly 14 over either the upper slip wedge 13 or lower slip wedge 15 during high pressure differential axial loading conditions on the bridge plug 10.

Similarly, the lower slip wedge 15 is identical to the upper slip wedge 14 described hereinbefore and, therefore, will not be described in detail. However, it should be noted that one end of lower slip wedge 15 is secured by a plurality of threaded members 107 engaging threaded holes 31 in bridge plug mandrel 11 while the other end of lower slip wedge 15 is centered by bore 77' on the bridge plug mandrel 11.

Slips 17' are identical to slips 17 described hereinbefore, with each slip 17' having one end supported on the lower slip wedge 15 while the other end of the slip 17' is supported in an annular channel in cylindrical portion of the lower slip support 16.

To retain the slips 17 and 17', each slip having one end resting on the appropriate slip wedge with the other end being supported in the appropriate annular channel, cylindrical metal bands 108 which are rectangular in cross section are installed in channel 68 or 68' of the slips 17 or 17' respectively. Upon setting of the bridge plug 10, the metal bands 108 are broken to allow the slips 17 and 17' to engage the wellbore.

The lower slip support 16 comprises a member having an irregularly shaped exterior surface and interior surface. The exterior surface of the lower slip support 16 comprises a first cylindrical portion 109 having an annular channel 110 located therein, a second cylindrical portion 111 having a plurality of transverse bores 112 and transverse threaded bores 113 which receive threaded pins 114 therein which, in turn, secure the lower slip support 16 to the bridge plug mandrel 11 to prevent the rotation of the lower slip support 16 on the bridge plug mandrel 11, a conical portion 115 and a third cylindrical portion 116 having a threaded portion 117 thereon.

The interior surface of the lower slip support 16 comprises a first cylindrical bore 118, a threaded bore 119 terminating in annular channel 120 and a second cylindrical bore 121. The lower slip support 16 is secured to the bridge plug mandrel 11 by means of threaded bore 119 engaging threaded section 30 of the bridge plug mandrel 11.

Retained on the third cylindrical portion 116 of the lower slip support 16 is catcher tube 122. The catcher tube 122 comprises an elongated annular member having a threaded portion 123 at the upper end thereof, having a plurality of holes 124 in the intermediate portion thereof, having a threaded portion 125 at the lower end thereof and having a plug 126 installed in the lower end thereof. The upper threaded portion 123 and lower threaded portion 125 each have a plurality of threaded holes 127 therein which receive threaded members 128 therein. The plug 126 comprises a cylindrical member having a cylindrical portion 129 which has threaded portion 129', having a first bore 130, having a second bore 131 and having a plurality of holes 132 insecting second bore 131 thereby allowing second bore 131 to communicate with the exterior of the plug 126.

The catcher tube 122 is secured to the lower slip support 16 by means of the upper threaded portion 123 of the tube engaging threaded portion 117 of the lower slip support. Similarly, the plug 126 is secured to the catcher tube 122 by means of the threaded portion 129 of the plug engaging lower threaded portion 125 of the catcher tube 122. The threaded pins 128 which engage threaded holes 127 in the catcher tube also engage cylindrical portion 116 of the lower slip support 16 and cylindrical portion 129 of the plug 126 to help secure the catcher tube 122 to the lower slip support 116 and the plug 126 to the catcher tube 122.

Installed in the bridge plug mandrel 11 is a tension sleeve 39. The tension sleeve 39 comprises an annular member having an external threaded portion 40, an internally threaded portion 41 and a reduced thickness portion 42.

When the tension sleeve 39 is installed in the bridge plug mandrel 11, the tension sleeve 39 has externally threaded portion 40 engaging threaded portion 23 of bore 22 with annular chamfer 44 abutting annular seat 21 of the bridge plug mandrel 11. The reduced thickness portion 42 is formed such that upon the application of a predetermined axial load applied from above through internally threaded portion 41 of the tension sleeve 39, the tension sleeve 39 will separate at the reduced thickness portion. Although the tension sleeve 39 may be formed of any suitable metal, brass is preferred.

Also installed in the bridge plug mandrel 11 is an ejectable plug assembly 140. The ejectable plug assembly 140 comprises a sleeve member 141 and plug 142.

The sleeve member 141 comprises an annular member having a closed bottom and an open end. The upper end of the sleeve member 141 comprises a plurality of collet fingers 143 having heads 144 thereon with each head 144 having a threaded aperture 145 formed therein. The remaining portion of the sleeve member 141 is formed with a first portion of the exterior surface having annular channels 146 receiving seal members 147 therein and a second portion of the exterior surface which is of smaller diameter than the the first portion having a plurality of holes 148 therein while interior bore 149 is formed with annular channels 150 receiving seal members 151 therein. The annular channels 150 are formed such that the plurality of holes 148, which allow communication between the exterior of the sleeve and the bore 149, are located between the annular channels.

The plug 142 comprises a cylindrical member having a first cylindrical portion 152, second cylindrical portion 153 having blind threaded holes 154 therein, third cylindrical portion 155 having holes 156 therein, fourth cylindrical portion 157 and bore 158. The second cylindrical portion 153 of the plug 142 having blind threaded holes 154 therein is approximately the same diameter as the internal diameter of the heads 144 of the collet fingers 143. Similarly, fourth cylindrical portion 157 is approximately the same diameter as bore 149 of the sleeve member 141. When installed in the sleeve member 141, the plug 142 is held in position by a plurality of threaded members 159 which engage threaded holes 145 in the heads 144 of the collet fingers 143 and engage blind threaded holes 154 in the plug 142 while the fourth cylindrical portion 157 of the plug 142 sealingly engages bore 149 of the sleeve member 141 with the seal members 151 retained in annular channels 150 engage the plug 142 thereby preventing any flow through holes 148 in the sleeve member 141. It should be noted that when installed in the bridge plug mandrel 11, since the second portion of the exterior surface of the sleeve member 141 is of a lesser diameter than the central bore 25 of the bridge plug mandrel 11, unless blocked by plug 142 fluid can flow through holes 148 in the sleeve member 141 from the exterior thereof to the interior thereof.

When the ejectable plug assembly 140 is installed in the bridge plug mandrel 11, the ejectable plug assembly 140 is prevented from downward movement in the mandrel 11 by the angular surfaces 160 the heads 144 of the collect fingers 143 abutting the chamfered annular seat 24 of the second bore 22 of the bridge plug mandrel 11 and is prevented from disengaging the second bore 22 by upward movement in the mandrel 11 by the upper surfaces 161 of the heads 144 of the collet fingers 143 abutting the bottom surface of the externally threaded portion 40 of the tension sleeve 39 installed in the mandrel 11.

To set the bridge plug 10 in a wellbore, a setting tool in inserted into the bore of the bridge plug mandrel 11 so that a portion of the setting tool threadedly engages threaded portion 41 of tension sleeve 39. After the setting tool having the bridge plug 10 installed thereon is run into a wellbore, the upper slips 17 are engaged with the wellbore by a tubular sleeve of the setting tool engaging lock ring 57 to expand the lock ring so that the tubular sleeve of the setting tool ultimately abuts the lower wall of cavity 56 of the upper slip support 12. Continued advancement of the tubular sleeve of the setting tool causes the upper slip support 12 to be advanced downwardly along the bridge plug mandrel 11 thereby causing the slips 17 to advance along upper slip wedge 13 and to be cammed into engagement with the wellbore. When the slips 17 are being cammed into engagement with the wellbore, the band 108 is broken thereby allowing the slips 17 to freely engage the wellbore.

After the upper slips have been engaged with the wellbore, the packer assembly 14 and lower slips 17' are forced into engagement with the wellbore by pulling on the setting tool which threadedly engages threaded portion 41 of the tension sleeve 39 which, in turn, is secured to the bridge plug mandrel 11. By pulling on the bridge plug mandrel 11 through tension sleeve 39 the lower slips 17' are cammed into engagement with the wellbore when the band 108 is broken while continued pulling on the bridge plug mandrel 11 through tension sleeve 39 subsequently cause the screws 81 and 107 to be sheared thereby releasing the upper slip wedge 13 and lower slip wedge 15 respectively to compress the packer assembly 14 therebetween. As the bridge plug mandrel 11 is moved upward, the upper slip wedge 13 cams slips 17 more tightly into engagement with the wellbore, the slips 17' moving along lower slip wedge 15 are cammed tightly into engagement with the wellbore and the movement of the upper 13 and lower 15 slip wedges along the bridge plug mandrel 11 causes the packer assembly 14 to be compressed tightly into engagement with the wellbore. At a predetermined force the reduced thickness portion 42 of the tension sleeve 39 is severed by overstressing of the material thereby causing any relative movement between the upper slip support 12 and the bridge plug mandrel 11 to cease. At this time, the bridge plug 10 is retained in the wellbore with the packer assembly 14 sealingly engaging the wellbore by the slips 17 or 17' having their serrated surfaces 65 or 65' respectively engaging the wellbore. By selecting a tension sleeve 39 having the proper reduced thickness portion 42 at which the tension sleeve will be sheared by the application of an upward force to the bridge plug mandrel 11, damage to the wellbore by the slips 17 and 17' and the packer assembly 14 through the overcompression thereof is prevented.

Figure 2:
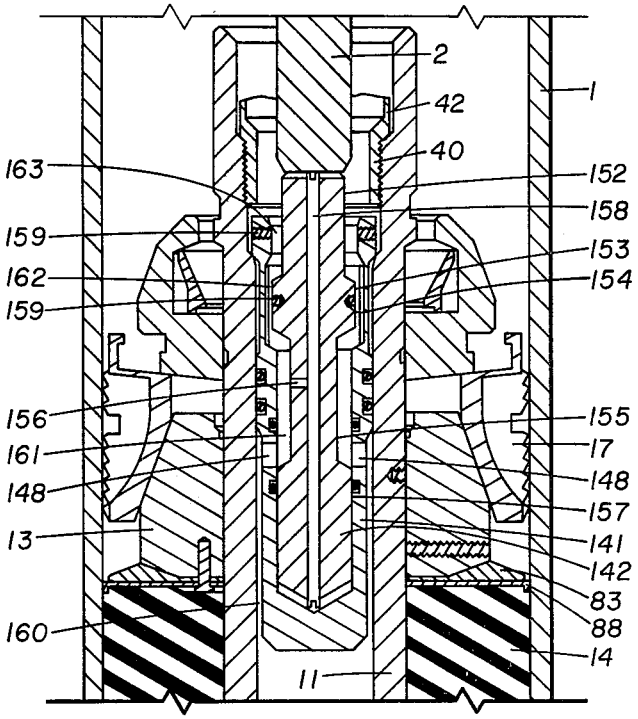
FIG. 2 is a cross-sectional view of a portion of the preferred embodiment as illustrated in FIG. 1 showing the plug portion of the ejectable plug assembly being actuated to equalize the differential pressure acting across the present invention.

Referring to FIG. 2, the bridge plug 10 is shown after it has been set in the wellbore 1 and with the plug 142 of the ejectable plug assembly 140 actuated by a tool 2 installed on the drill string (not shown) to equalize the pressure across the bridge plug 10 prior to the removal of the bridge plug 10 from the wellbore 1.

Prior to the removal of the bridge plug 10 from the wellbore 1 it is desirable to allow any pressure in the wellbore 1 from below the bridge plug 10 to be vented or equalized with the pressure acting above the bridge plug 10 in the wellbore 1. Since the bridge plug 10 is typically removed from the wellbore 1 by a milling operation using a special milling tool or by a drilling operation using a conventional drill bit, if the pressure differential acting across the bridge plug 10 is not equalized before the slips 17 of the bridge plug 10 are destroyed thereby freeing the bridge plug 10 to move upwardly in the wellbore 1, the pressure differential acting across the total area of the bridge plug can provide lifting force of sufficient magnitude to lift the drill string from the wellbore.

To equalize any pressure differential acting across the bridge plug 10, a force of sufficient magnitude to shear threaded members 159 holding plug 142 in sleeve member 141 of the ejectable plug assembly 140 thereby releasing the plug 142 and allowing it to move downwardly in the sleeve member 141 until the bottom surface of the plug 142 abuts the bottom of bore 149 in the sleeve member 141. It should be noted that only a force sufficient to shear threaded members 159 need be applied to the plug 142 in order to move it to the lower most position in the sleeve member 141 since bore 158 in the plug 142 allows any pressure acting in either end of the plug 142 to be equalized across the plug 142.

When the plug 142 is in the lower most position in the sleeve member 141 with bottom surface of the plug 142 abutting the bottom of bore 149, holes 148 in the sleeve member 141 allow any pressure differential across the bridge plug 10 to be equalized by completing a flow path across the bridge plug 10 comprising annular space 160 which is formed by the bridge plug mandrel 11 and sleeve member 141, holes 148, annular space 161 which is formed by bore 149 of the sleeve member 141 and the third cylindrical portion 155 of the plug 142, annular space 162 which is formed by the bridge plug mandrel 11 and the second cylindrical portion 153 of the plug 142 and annular space 163 which is formed by the bridge plug mandrel 11 and the first cylindrical portion 152 of the plug 142. It should be understood that collet fingers 143 extend into and partially occupy a portion of annular space 162 and annular space 163.

When the plug 142 is in the lower most position in the sleeve member 141, the plug 142 will remain in that position without any pressure differential acting across the plug from below causing the plug to move upwardly since the pressures acting across the plug 142 will be equalized via holes 156 and bore 158 therein which are in communication.

Figure 3:
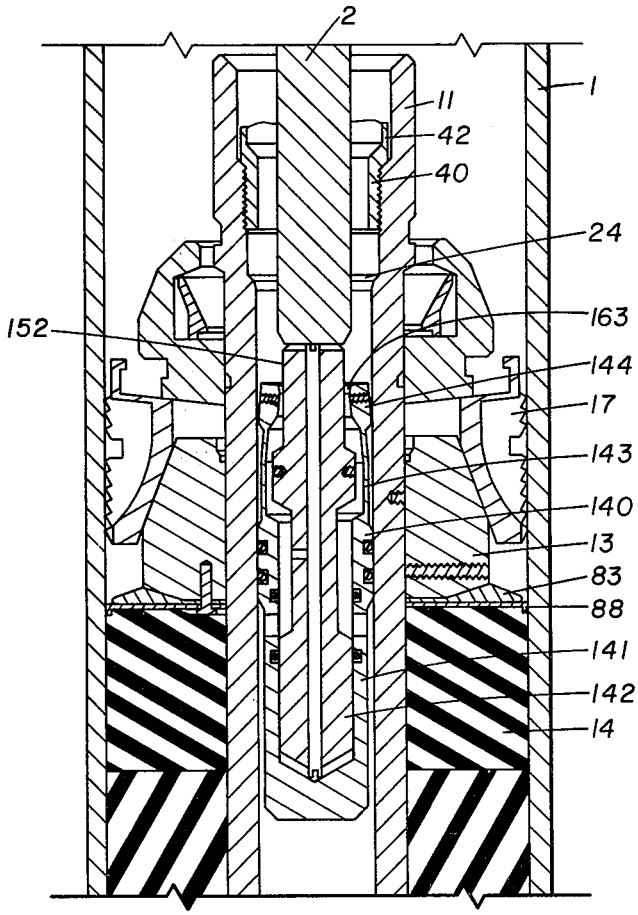
FIG. 3 is a cross-sectional view of a portion of the preferred embodiment as illustrated in FIG. 1 showing the ejectable plug assembly being removed from the bore of the present invention.

Referring to FIG. 3, the ejectable plug assembly 140 is shown being removed from the bridge plug mandrel 11. After the pressure differential acting across the bridge plug 10 has been equalized or at such time as the pressure differential is low enough to permit, the ejectable plug assembly 140 can be removed from the bridge plug mandrel 11 by means of tool 2 pushing the ejectable plug assembly 140 downwardly through the bridge plug mandrel 11 and out into the catcher tube 122 where the ejectable plug assembly will be retained therein. The ejectable plug assembly 140 can be removed from the bridge plug mandrel 11 when the plug 142 is in its lower most position in the sleeve member 141 by applying a sufficient force to the plug 142 to cam the heads 144 of the collet fingers 143 out of engagement with chamfered annular seat 24 of the bridge plug mandrel 11 thereby allowing the ejectable plug assembly 140 to move downwardly in the bridge plug mandrel 11. The heads 144 of the collet fingers 143 are free to be cammed inwardly out of the engagement with chamfered annular seat 24 of the bridge plug mandrel 11 when the plug 142 is in its lower most position in the sleeve member 141 since annular space 163 between the first cylindrical portion 152 of the plug 142 and heads 144 of the collet fingers 143 is sufficiently large to allow the inward movement of the heads 144 of the collet fingers 143.

By pushing the ejectable plug assembly 140 downwardly through and out the bridge plug mandrel 11 by means of a tool 2 the mandrel 11 is open and free of any blockage. When the ejectable plug assembly 140 is removed from the bridge plug mandrel 11 it is retained by the catcher tube 122 and thereby prevented from contaminating or fouling the wellbore.

When the bridge plug mandrel 11 has the ejectable plug assembly 140 removed therefrom, the bridge plug mandrel 11 can be used as a guide for a milling tool when it is desired to remove the bridge plug 10 from the wellbore.

It can be easily seen that the present invention offers the advantages of:

An ejectable plug assembly which is simple to manufacture;

An ejectable plug assembly which is simple to install in the bridge plug;

An ejectable plug assembly which can be easily actuated using a simple tool;

An ejectable plug assembly which can be actuated by only applying a force necessary to shear the threaded members retaining the plug in the ejectable plug assembly;

An ejectable plug assembly which, when actuated, equalizes any pressure differential acting across the bridge plug;

An ejectable plug assembly which is retained by the bridge plug once it is removed from the bridge plug mandrel; and A bridge plug that can be removed from the wellbore either by a milling operation or a drilling operation.

Having thus described my invention, I claim:

1. A bridge plug for use in a wellbore to control the flow of fluid therethrough, said bridge plug comprising:

a bridge plug mandrel having a first bore terminating in an annular seat, a second bore terminating in a chamfered annular seat, and a central bore therethrough;

an upper slip support slidable on said bridge plug mandrel;

an upper slip wedge installed on said bridge plug mandrel;

a first plurality of slips, each slip of said first plurality of slips having one end retained by said upper slip support while the other end slidably engages said upper slip wedge;

an elastomeric packer assembly installed on said bridge plug mandrel;

a lower slip wedge installed on said bridge plug mandrel;

a lower slip support having a bore therethrough aligned with the central bore in said bridge plug mandrel and secured to one end of said bridge plug mandrel;

a second plurality of slips, each slip of said second plurality of slips having one end retained by said lower slip support while the other end slidably engages said lower slip wedge;

catcher tube means having one end thereof secured to said lower slip support in aligned relationship with the bore in said lower slip support, having plug means installed in the other end thereof, and having a plurality of holes therein; and plug valve assembly means installed in the second bore and central bore of said bridge plug mandrel comprising:

sleeve means retained in the second bore and central bore of said bridge plug mandrel, said sleeve means having the lower end thereof closed, having a portion of the exterior surface thereof in sealing engagement with the central bore of said bridge plug mandrel with the remaining portion of the exterior surface of said sleeve means above the portion of the exterior surface in sealing engagement with the central bore of said bridge plug mandrel including a plurality of collet finger means, each collet finger means having one end secured to said sleeve means with the other end having an enlarged end thereon engaging the chamfered annular seat of the second bore of said bridge plug mandrel, and with the remaining portion of the exterior surface of said sleeve means below the portion of the exterior surface in sealing engagement with the central bore of said bridge plug mandrel having a smaller diameter than the central bore of said bridge plug mandrel thereby creating an annular space between the remaining portion of the exterior surface of said sleeve means and the central bore of said bridge plug mandrel, and having a plurality of passage means allowing communication between the remaining portion of the exterior surface of said sleeve means and the bore of said sleeve means; and plug means retained within the bore of said sleeve means, said plug means comprising:

a lower portion having substantially the same diameter as the bore of said sleeve means;

an intermediate portion having a smaller diameter than the diameter of the bore of said sleeve means thereby creating an annular space between the intermediate portion of said plug and the bore of said sleeve means;

an upper portion having a portion of the surface thereof substantially engaging the heads of said collet fingers with the remaining portion thereof having a smaller diameter than the portion of the surface substantially engaging the heads of said collet fingers;

an axial bore allowing communication between the end surfaces of said plug means; and a plurality of passage means located in the intermediate portion of said plug means allowing communication between the exterior surface of the intermediate portion of said plug means and the axial bore of said plug means, said plug means being operable between a first position where said plug means sealingly engages said bore in said sleeve means blocking said plurality of passage means and a second position where said plug means permits communication between the bore of said sleeve means and the central bore of said bridge plug mandrel via said plurality of passage means in said sleeve means; and means for retaining said plug means in said first position in said sleeve means blocking said plurality of passage means whereby said plug valve assembly means when installed in said bridge plug mandrel either prevents the flow of said fluid therethrough or allows the restricted flow of said fluid therethrough to allow the pressure of said fluid to equalize across said bridge plug after said plug means of said plug valve assembly means is in a second position in said plug valve assembly means, or when removed from said bridge plug mandrel by being pushed therethrough is retained in said catcher tube means thereby allowing the unrestricted flow of said fluid through said bridge plug and preventing the contamination of said wellbore by said plug valve assembly means.

2. A bridge plug for use in a wellbore to control the flow of fluid therethrough, said bridge plug comprising:

a bridge plug mandrel having a bore therethrough;

an upper slip support slidable on said bridge plug mandrel;

an upper slip wedge installed on said bridge plug mandrel;

a first plurality of slips, each slip of said first plurality of slips having one end retained by said upper slip support while the other end slidably engages said upper slip wedge;

an elastomeric packer assembly installed on said bridge plug mandrel;

a lower slip wedge installed on said bridge plug mandrel;

a lower slip support having a bore therethrough aligned with the bore in said bridge plug mandrel and secured to one end of said bridge plug mandrel;

a second plurality of slips, each slip of said second plurality of slips having one end retained by said lower slip support while the other end slidably engages said lower slip wedge;

wherein the improvement comprises:

the bore in said bridge plug mandrel including a first bore terminating in an annular seat, a second bore terminating in a chamfered annular seat, and a central bore therethrough;

catcher tube means having one end thereof secured to said lower slip support in aligned relationship with the bore in said lower slip support, having plug means installed in the other end thereof, and having a plurality of holes therein; and plug valve assembly means installed in the second bore and central bore of said bridge plug mandrel comprising:

sleeve means retained in the second bore and central bore of said bridge plug mandrel, said sleeve means having the lower end thereof closed, having a portion of the exterior surface thereof in sealing engagement with the central bore of said bridge plug mandrel with the remaining portion of the exterior surface of said sleeve means above the portion of the exterior surface in sealing engagement with the central bore of said bridge plug mandrel including a plurality of collet finger means, each collet finger means having one end secured to said sleeve means with the other end having an enlarged end thereon engaging the chamfered annular seat of the second bore of said bridge plug mandrel, and with the remaining portion of the exterior surface of said sleeve means below the portion of the exterior surface in sealing engagement with the central bore of said bridge plug mandrel having a smaller diameter than the central bore of said bridge plug mandrel thereby creating an annular space between the remaining portion of the exterior surface of said sleeve means and the central bore of said bridge plug mandrel, and having a plurality of passage means allowing communication between the remaining portion of the exterior surface of said sleeve means and the bore of said sleeve means; and plug means retained within the bore of said sleeve means, said plug means comprising:

a lower portion having substantially the same diameter as the bore of said sleeve means;

an intermediate portion having a smaller diameter than the diameter of the bore of said sleeve means thereby creating an annular space between the intermediate portion of said plug and the bore of said sleeve means;

an upper portion having a portion of the surface thereof substantially engaging the heads of said collet fingers with the remaining portion thereof having a smaller diameter than the portion of the surface substantially engaing the heads of said collet fingers;

an axial bore allowing communication between the end surfaces of said plug means; and a plurality of passage means located in the intermediate portion of said plug means allowing communication between the exterior surface of the intermediate portion of said plug means and the axial bore of said plug means, said plug means being operable between a first position where said plug means sealingly engages said bore in said sleeve means blocking said plurality of passage means and a second position where said plug means permits communication between the bore of said sleeve means and the central bore of said bridge plug mandrel via said plurality of passage means in said sleeve means; and means for retaining said plug means in said first position in said sleeve means blocking said plurality of passage means whereby said plug valve assembly means when installed in said bridge plug mandrel either prevents the flow of said fluid therethrough or allows restricted flow of said fluid therethrough to allow the pressure of said fluid to equalize across said bridge plug after said plug means of said plug valve assembly means is in a second position in said plug valve assembly means, or when removed from said bridge plug mandrel by being pushed therethrough is retained in said catcher tube means thereby allowing the unrestricted flow of said fluid through said bridge plug and preventing the contamination of said wellbore by said plug valve assembly means.

* * * * *